US006976874B2

(12) United States Patent
Sakurai et al.

(10) Patent No.: US 6,976,874 B2
(45) Date of Patent: Dec. 20, 2005

(54) TERMINAL FITTING AND CONNECTOR PROVIDED THEREWITH

(75) Inventors: Toshikazu Sakurai, Yokkaichi (JP); Yukihiro Fukatsu, Yokkaichi (JP)

(73) Assignee: Sumitomo Wiring Systems, Ltd., (JP)

( * ) Notice: Subject to any disclaimer, the term of this patent is extended or adjusted under 35 U.S.C. 154(b) by 0 days.

(21) Appl. No.: 10/864,853

(22) Filed: Jun. 9, 2004

(65) Prior Publication Data

US 2004/0253881 A1 Dec. 16, 2004

(30) Foreign Application Priority Data

Jun. 11, 2003 (JP) ..... 2003-166720

(51) Int. Cl.[7] ..... H01R 13/40
(52) U.S. Cl. ..... 439/595; 439/752
(58) Field of Search ..... 439/595, 752, 439/744, 752.5

(56) References Cited

U.S. PATENT DOCUMENTS

| | | | | |
|---|---|---|---|---|
| 5,478,263 | A * | 12/1995 | Kato | 439/752 |
| 6,520,801 | B2 | 2/2003 | Tabata et al. | 439/595 |
| 6,623,313 | B1 * | 9/2003 | Ichida et al. | 439/752.5 |
| 6,702,614 | B2 * | 3/2004 | Nakamura et al. | 439/595 |
| 6,702,627 | B2 * | 3/2004 | Nankou et al. | 439/752 |

* cited by examiner

*Primary Examiner*—Hae Moon Hyeon
(74) *Attorney, Agent, or Firm*—Gerald E. Hespos; Anthony J. Casella

(57) ABSTRACT

A male terminal fitting (10) can be inserted into a housing (30) and locked therein by a lock (35). A notch (21) is formed in an outer wall (18) of a substantially box-shaped main portion (12) of the terminal fitting (10) to permit entry of the lock (35). The lock (35) is engageable with the front cut end of the notch (21). A locking projection (22) engageable with the lock (35) is formed at the front cut end of the notch (21). A stabilizer (27) is provided at a side edge of the notch (21) for restricting catching of the rear edge of the locking projection (22).

13 Claims, 11 Drawing Sheets

TERMINAL FITTING AND CONNECTOR PROVIDED THEREWITH

BACKGROUND OF THE INVENTION

1. Field of the Invention

The invention relates to a terminal fitting and to a connector provided therewith.

2. Description of the Related Art

U.S. Pat. No. 6,520,801 discloses a terminal fitting locked in a housing by a lock. The terminal fitting has a substantially box-shaped main portion, and a notch is formed over a specified length in an outer wall of the main portion for permitting entry of the lock. The notch has a front cut end that is embossed to define a locking projection that projects towards the lock. The lock is engageable with the cut front end of the notch and with the locking projection. Thus, a large depth of engagement with the lock is ensured to enhance a locking force.

An operator's finger or a wire may catch the rear edge of the locking projection. Thus, portions of the outer wall near the locking projection may be deformed in a twisted manner, making it difficult to handle the terminal fitting. Therefore, there has been a demand for improvements.

The present was developed in view of the above problem and an object thereof is to improve the overall operability.

SUMMARY OF THE INVENTION

The invention relates to a terminal fitting to be inserted into a housing and locked by a lock in the housing. A notch is formed in an outer wall of a main portion for permitting entry of the lock. The notch has a cut front end and a locking projection projects out at the cut front end. The lock engages the locking projection and the front cut edge of the notch. A catch restricting portion is provided behind the locking projection and projects in substantially the same direction as the locking projection. Thus, external matter is less likely to catch the rear edge of the locking projection, and the terminal fitting can be handled more easily. Further, the catch restricting portion is at the side edge of the notch and can be formed from a portion of the outer wall cut out by the notch. Thus, the terminal fitting is produced at a low cost with a good yield.

The catch restricting portion preferably includes a stabilizer for entering an insertion groove in the housing to guide an inserting operation. Thus, the construction of the terminal fitting is simplified.

A distance between the catch restricting portion and the lock preferably is larger than an outer diameter of a wire to be connected to the terminal fitting.

An arcuate guiding surface preferably is formed on a rear surface of the catch restricting portion as seen in the inserting direction.

A protrusion preferably is embossed on the terminal fitting and preferably reaches substantially the same height as the locking projection.

The invention also relates to a connector comprising a housing having at least one cavity for receiving at least one of the above-described terminal fittings.

A distance between the catch restricting portion and the locking projection preferably is less than a length of a rear portion of a lateral wall of each cavity.

A retainer preferably is mountable to the housing for locking the terminal fittings therein.

A distance between the catch restricting portion and the locking projection preferably is less than a length of each lock.

A distance between the catch restricting portion and the protrusion preferably is less than the length of the lock.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A male terminal fitting according to the invention is identified by the numeral 10 in FIGS. 1 to 10. A plurality of the male terminal fittings 10 are accommodated in a housing 30 that preferably is provided with a retainer. In the following description, an inserting direction ID of the male terminal fittings 10 into the housing 30 and an opposite withdrawing direction thereof are referred to as forward and backward directions, respectively, and reference is made to all the figures except FIGS. 1 and 6 concerning the vertical direction.

Figure 6:
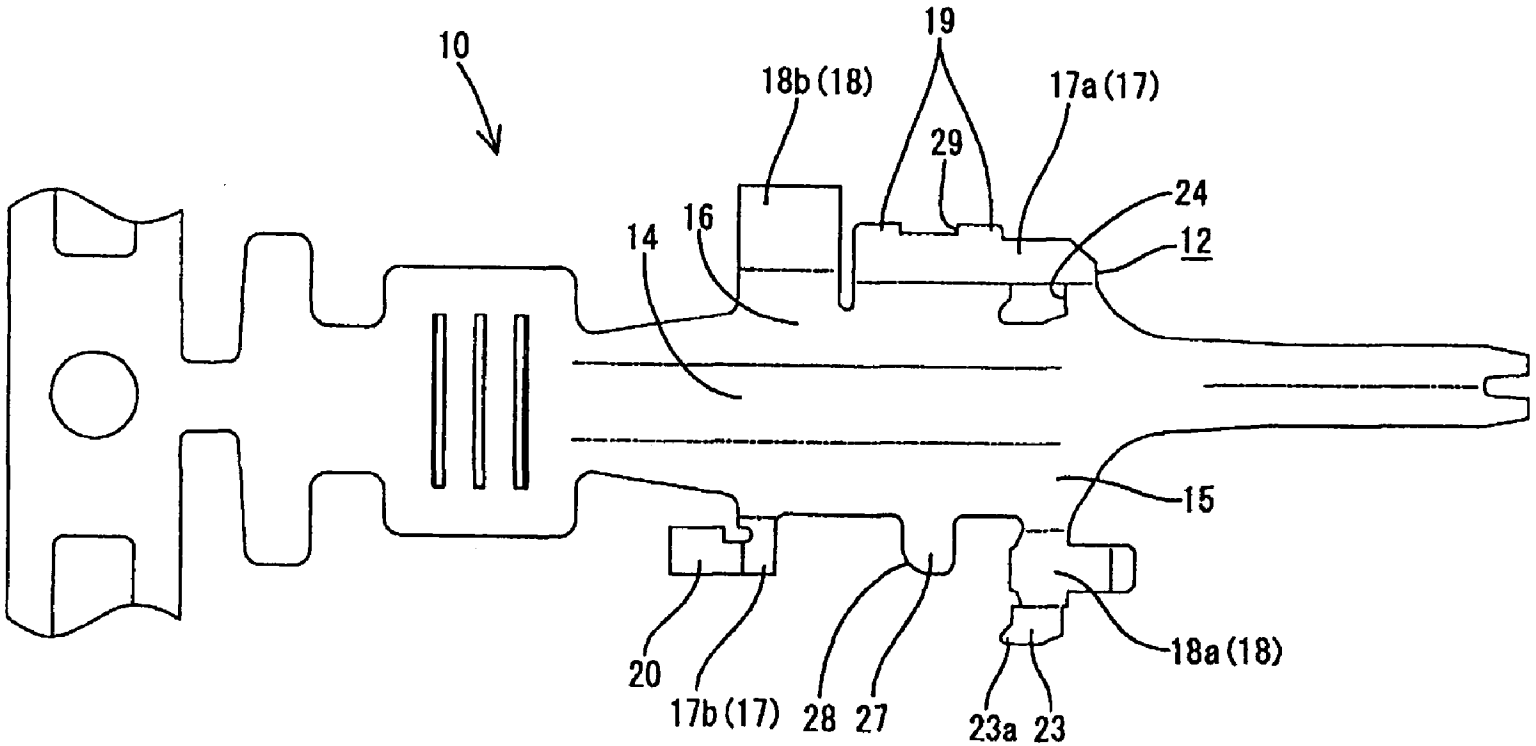
FIG. 6 is a development of the male terminal fitting.

The male terminal fitting 10 is formed by bending, folding and/or embossing a conductive metallic plate stamped or cut out to have a development shown in FIG. 6. More particularly, the male terminal fitting 10 has a tab 11, a substantially box-shaped main portion 12 and a barrel 13 in this order from the front. The tab 11 is electrically connectable with an unillustrated mating female terminal fitting and is formed from a long narrow plate piece that extends from the front edge of the main portion 12. The plate piece is folded along its longitudinal direction so that the opposed halves are in close contact. The barrel 13 includes two facing front crimping pieces that are to be crimped, bent or folded into connection with a core of the wire W and two facing rear crimping pieces that are crimped into connection an insulation coating of the wire W.

The main portion 12 has a bottom wall 14 that extends along forward and backward directions and first and second side walls 15, 16 stand up from opposite side edges of the bottom wall 14. A ceiling wall 17 and an outer wall 18 project in from the upper edges of the side walls 15, 16 and are disposed one over the other. The ceiling wall 17 and the outer wall 18 are divided into front and rear portions that are coupled to front and rear sections of the side walls 15, 16. More specifically, a front portion 17*a* of the ceiling wall 17 is coupled to a front part of the second side wall 16, whereas a rear portion 17*b* of the ceiling wall 17 is coupled to the rear part of the first side wall 15 of FIG. 1. Supporting pieces 19 project from the projecting end of the front portion 17*a* of the ceiling wall 17 and contact the upper end surface of the first side wall 15 for supporting the front portion 17*a* of the ceiling wall 17 horizontally. A closing plate 20 is bent at a substantially right angle from the rear end of the rear portion 17*b* of the ceiling wall 17 and extends towards the bottom wall 14 (see FIG. 4) for substantially closing a rear opening of the main portion 12.

A front portion 18*a* of the outer wall 18 is coupled to a front part of the first side wall 15, whereas a rear portion 18*b* of the ceiling wall 18 is coupled to the rear part of the second side wall 16. The front and rear portions 18*a*, 18*b* of the outer wall 18 are spaced along forward and backward directions by a specified length to define a notch 21 therebetween. The rear end of the front portion 18*a* of the outer wall 18 is embossed or cut and bent to project down and out to form a locking projection 22. The rear end surfaces of the locking projection 22 and the front portion 18*a* of the outer wall 18 define slanted locking surfaces that overhang at an obtuse angle$\alpha$ (i.e. $90° < \alpha < 180°$) to the inserting direction ID to the housing 30. Further, a holding piece 23 is provided at the projecting end of the front portion 18*a* of the outer wall 18 and projects towards the second side wall 16. The holding piece 23 is fit into a holding groove 24 formed by cutting the side wall 16 out. Thus, the front portion 18*a* of the outer wall 18 can be held so as not to shake along forward and backward directions. A projected portion 23*a* is provided at the rear end of the holding piece 23 and engages the bottom edge of the holding groove 24 to prevent the front portion 18*a* of the outer wall 18 from being turned. The rear end of the rear portion 18*b* of the outer wall 18 is embossed to project down and out to form a protrusion 25 that reaches substantially the same height as the locking projection 22.

Figure 7:
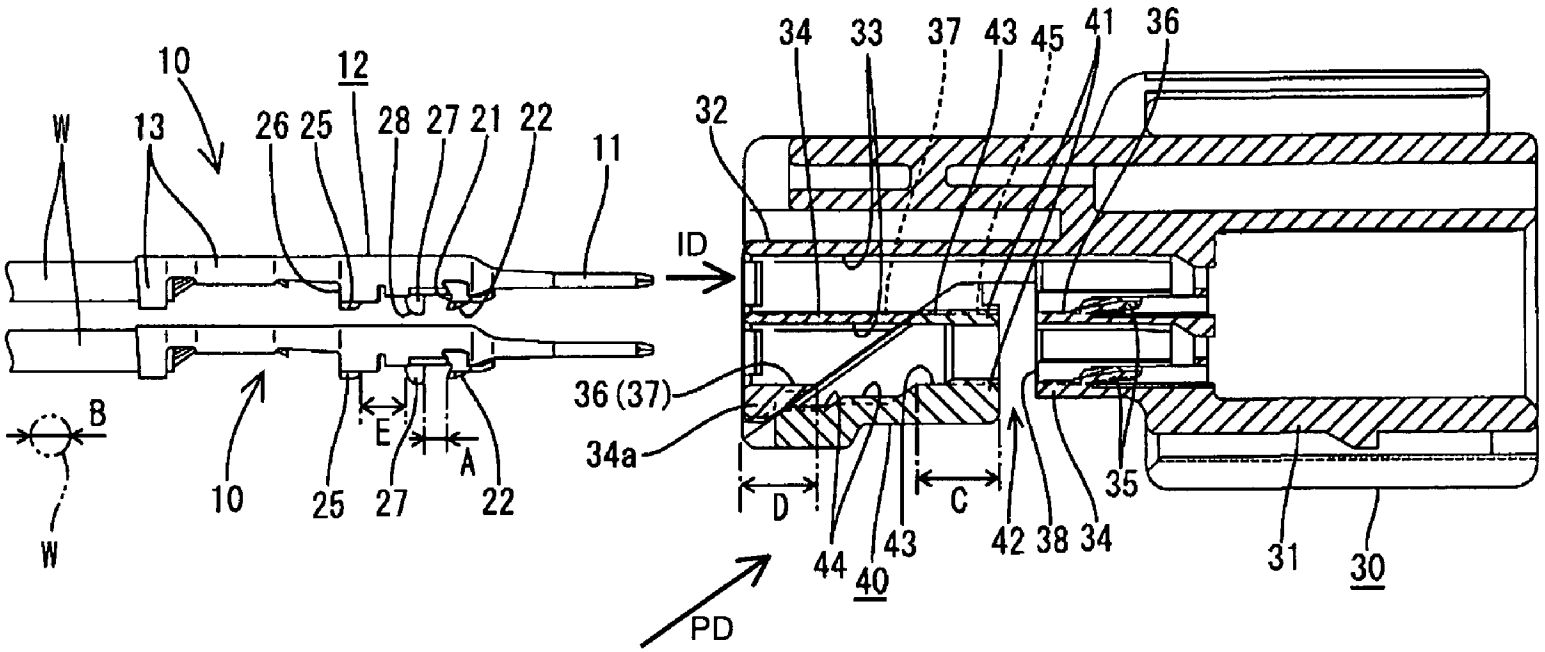
FIG. 7 is a side view in section showing a housing having a retainer mounted at a partial locking position, and male terminal fittings.

The housing 30 is made e.g. of a synthetic resin, and has a forwardly open rectangular tubular receptacle 31 and a block-shaped terminal accommodating portion 32 coupled one after the other as shown in FIG. 7. Cavities 33 are provided substantially side-by-side at each of upper and lower stages in the terminal accommodating portion 32 for receiving the male terminal fittings 10 from behind. A lock 35 cantilevers forward in each cavity 33 and is resiliently deformable substantially up and down in directions intersecting the inserting and withdrawing directions ID of the male terminal fittings 10. A protrusion insertion groove 36 is formed over substantially the entire length in the widthwise center of the bottom surface of the cavity 33 for receiving the locking projection 22 and the protrusion 25, and a stabilizer insertion groove 37 is formed along a side of this bottom surface at a front side with respect to a direction normal to the plane of FIG. 7. The protrusion insertion groove 36 is formed over substantially the entire length of the lock 35 to reduce the resilient deformation of the lock 35 during the insertion of the male terminal fitting 10. The stabilizer insertion grooves 37 are deeper than the protrusion insertion grooves 36 at the upper stage, which is the stage where the wall with stabilizer insertion grooves separates the cavity from an adjacent cavity. However, the grooves 36, 37 have substantially same the depth at the lower stage.

A retainer mount hole 38 is formed in the bottom surface and the opposite side surfaces of the terminal accommodating portion 32 for receiving the retainer 40. Accordingly, the retainer mount hole 38 is open in three directions. The retainer mount hole 38 exposes all of the cavities 33 to the outside and has a depth to cut off about the halves of the side walls that partition the cavities 33 at the upper stage. The bottom walls 34 of the cavities 33 at the upper stage and the opposite side walls and the bottom walls 34 of the cavities 33 at the lower stage are divided into front and rear portions by the retainer mount hole 38. The front edge of the retainer mount hole 38 extends substantially straight along the vertical direction, which is substantially normal to the insertion direction ID. However, the rear edge of the retainer mount hole 38 is inclined down to the back side and an angle of about 35° (smaller than 45°) to the inserting direction ID of the male terminal fittings 10.

The retainer 40 is made e.g. of a synthetic resin and has locking sections 41 arranged at upper and lower stages for engaging the locking steps 26 and the protrusions 25 of the male terminal fittings 10. The retainer 40 is mounted into the retainer mount hole 38 of the housing 30 for oblique movement along the pushing direction PD and substantially along the rear edge of the retainer mount hole 38 between a partial locking position (see FIG. 7) and a full locking position. The locking sections 41 substantially align with the bottom walls 34 of the respective cavities 33 when the retainer 40 is in the partial locking position to permit insertion and withdrawal of the male terminal fittings (see FIG. 7). However, the locking sections 41 are in the cavities 33 when the retainer 40 is in the full locking position to engage the locking steps 26 and the protrusions 25 (see FIG. 9). An escaping recess 43 is formed at the rear side of each locking section 41 to permit the projecting parts (barrel 13, etc.) of the male terminal fitting 10 and the wire W to escape. An escaping recess 44 is formed in a wall behind each locking section 41 at the lower stage and is lower than the escaping recess 43. Each locking section 41 also has a stabilizer passing groove 45 that communicates with the stabilizer insertion groove 37 when the retainer 40 is at the partial locking position. Since the retainer 40 is obliquely movable, a specified clearance 42 is defined between the front edge of the retainer mount hole 38 and the front surface of the retainer 40 at the partial locking position. The retainer 40 can be held selectively at the partial locking position and the full locking position in the housing 30 by unillustrated holding means.

Figure 1:
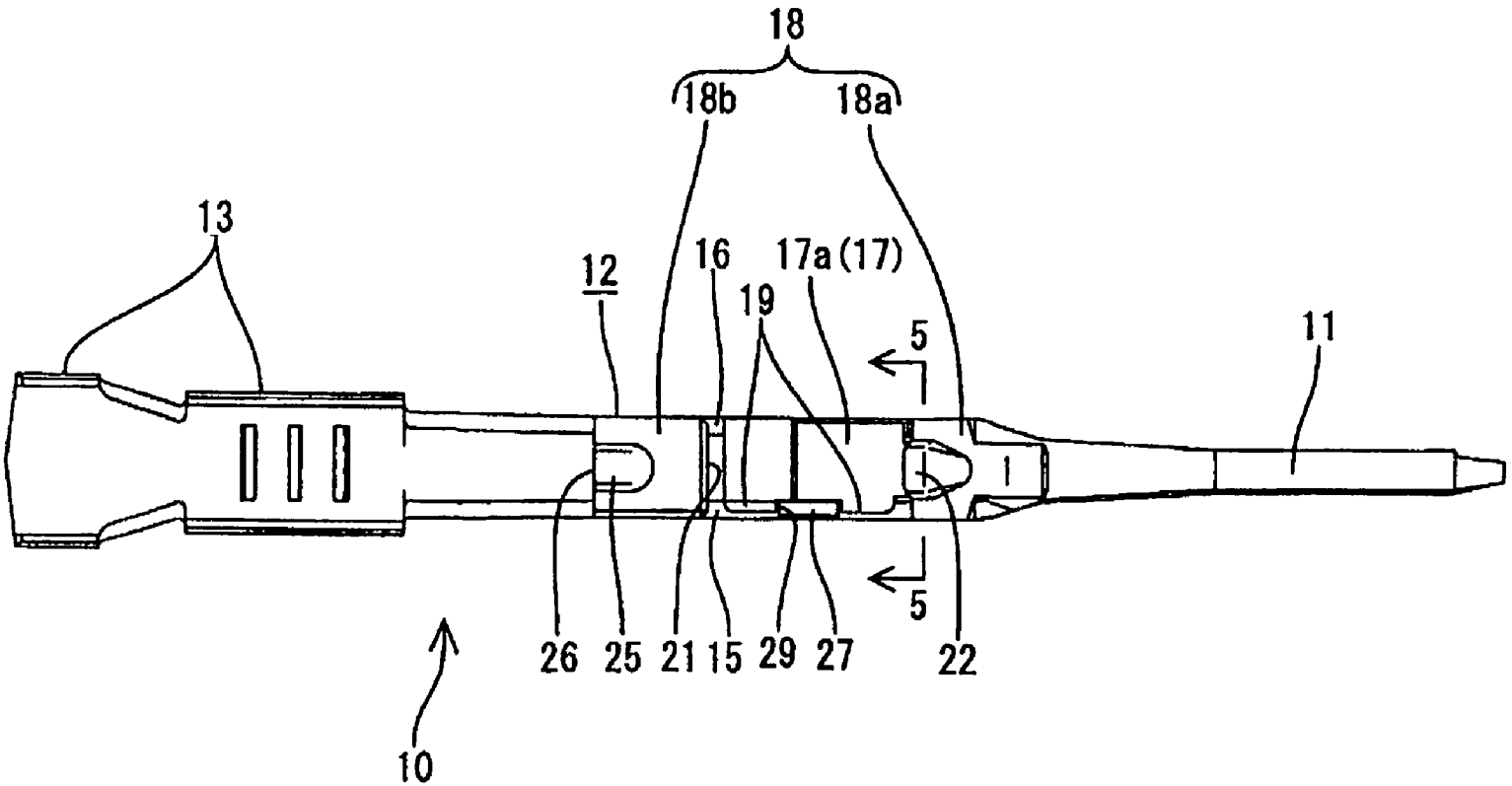
FIG. 1 is a plan view of a male terminal fitting according to one embodiment of the invention.
Figure 2:
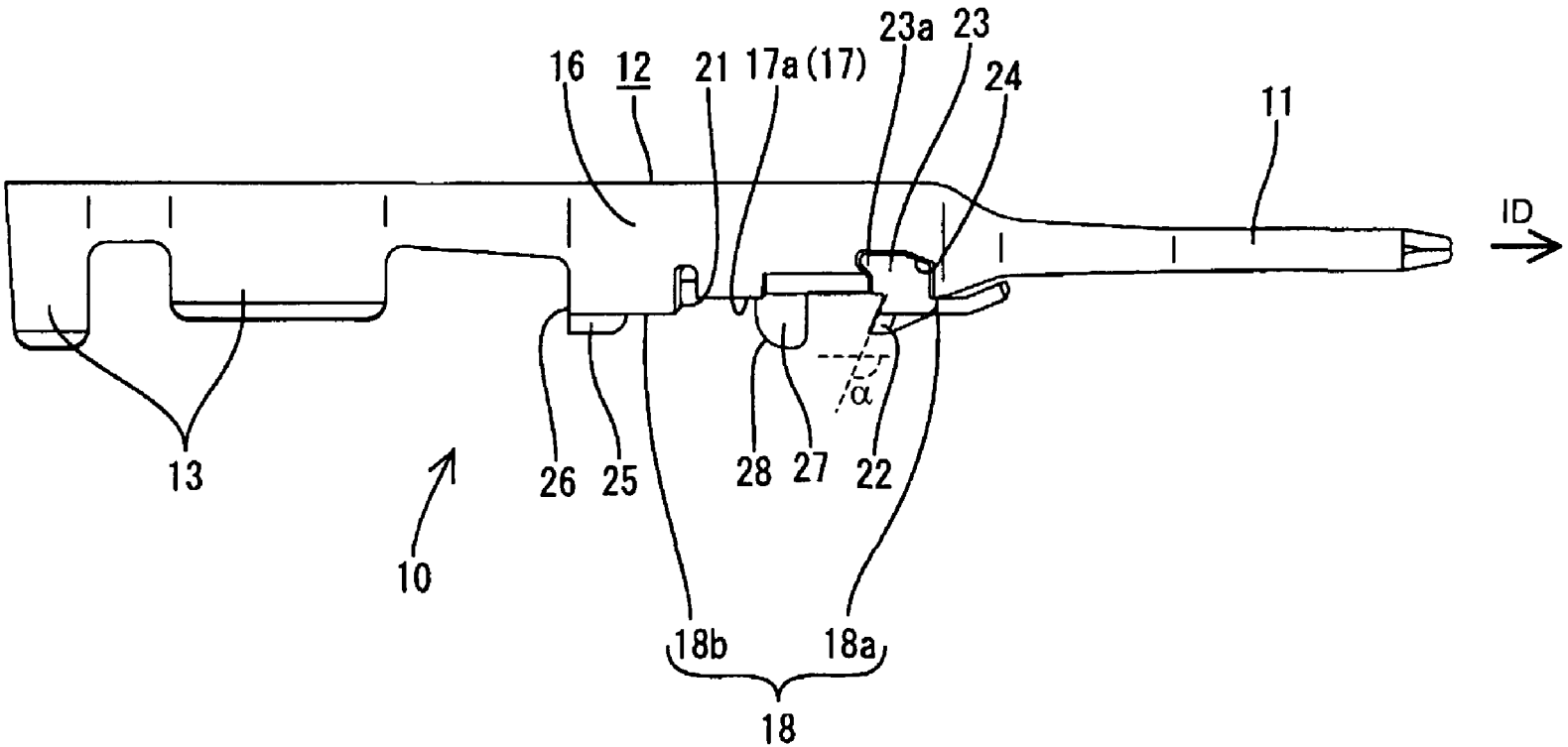
FIG. 2 is a left side view of the male terminal fitting.
Figure 3:
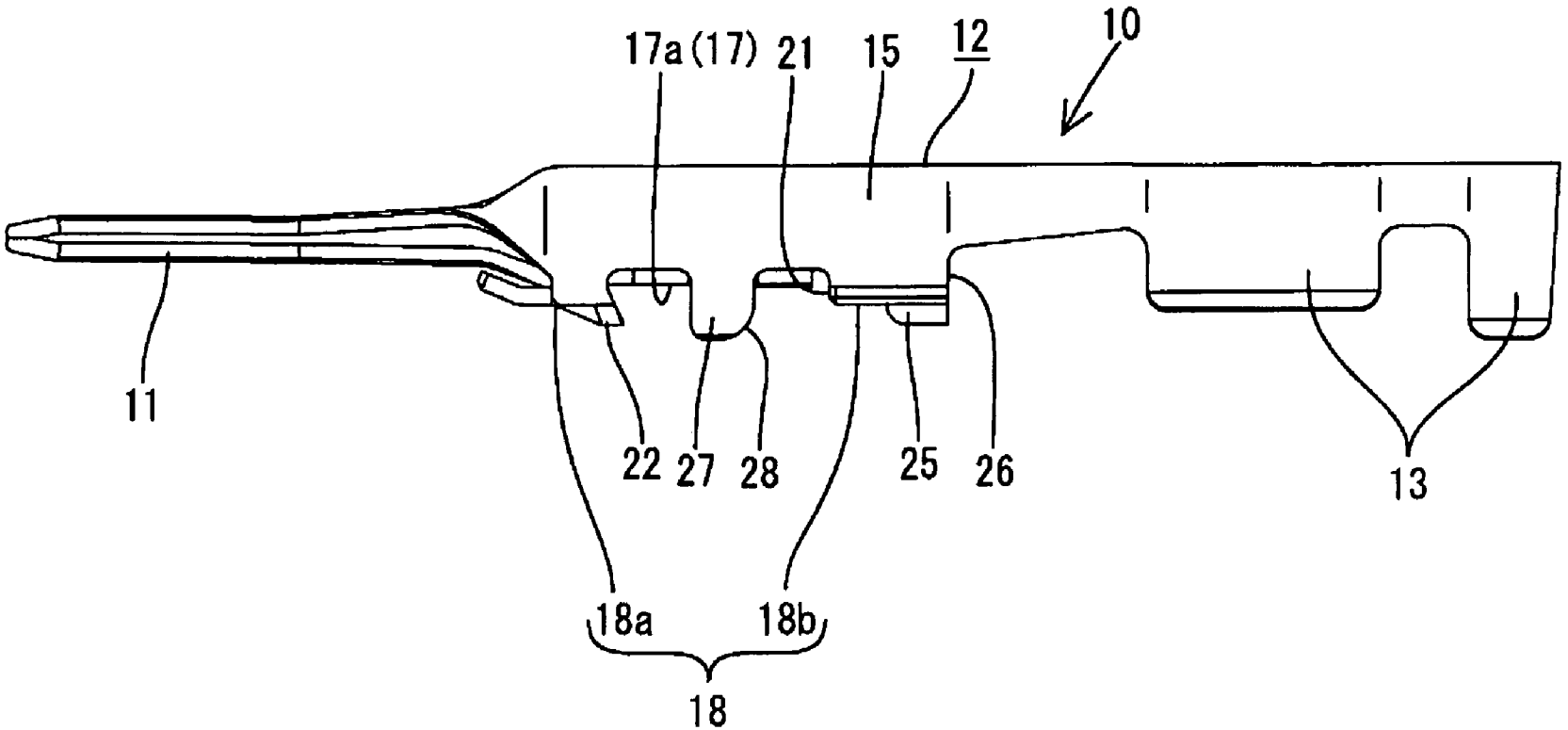
FIG. 3 is a right side view of the male terminal fitting.
Figure 4:
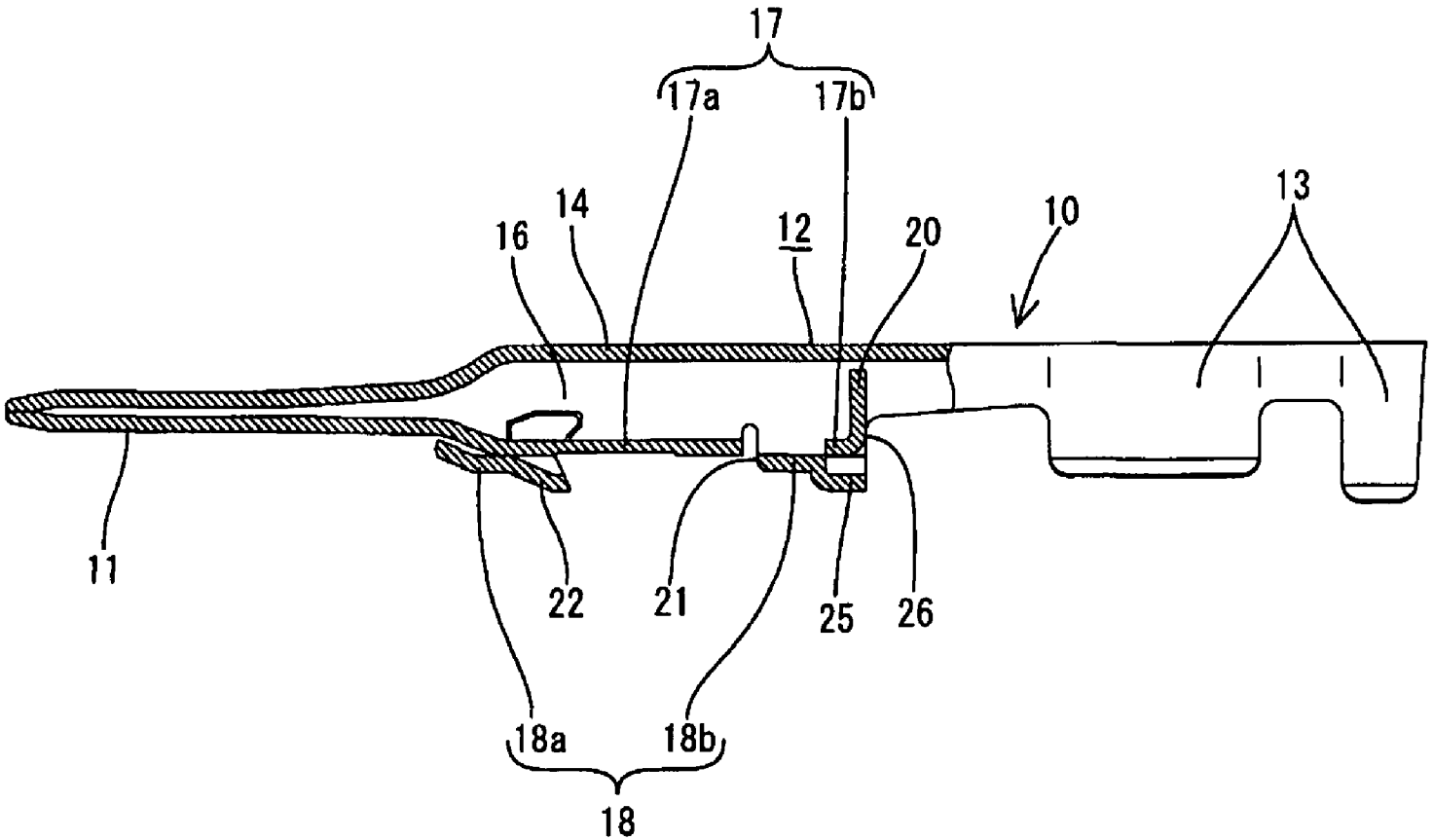
FIG. 4 is a side view in section of the male terminal fitting.
Figure 5:
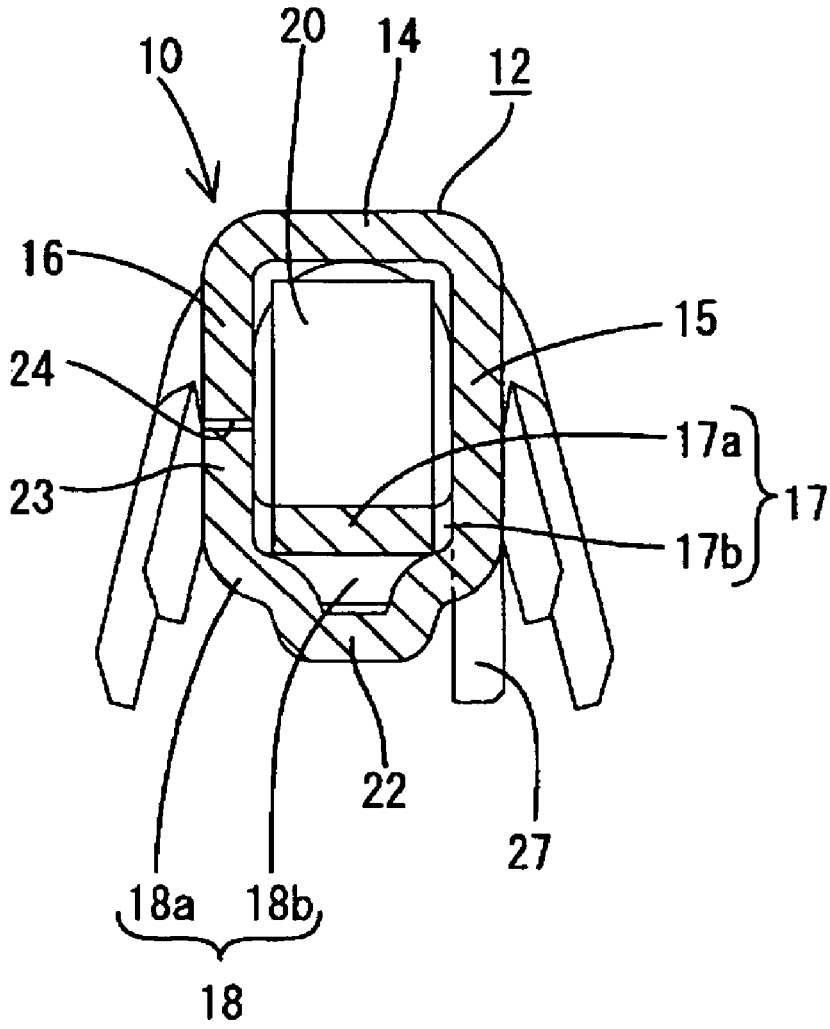
FIG. 5 is a section along 5—5 of FIG. 1.

The stabilizer 27 projects down at the end of the side wall 15 of the main portion 12 of the male terminal fitting 10, as shown at the lower side in FIG. 1. The stabilizer 27 is in an area of the upper end of the side wall 15 and at a substantially longitudinal middle position of the notch 21. More particularly, the stabilizer 27 is spaced back by a distance A from the rear end surface of the locking projection 22 (FIG. 7). The front 18*a* of the outer wall 18 is coupled to the upper end of the side wall 15, which is where the stabilizer 27 is provided. Thus, the stabilizer 27 is formed from a portion of the outer wall 18 cut out by the notch 21 (see FIG. 6). A projecting distance of the stabilizer 27 exceeds the projecting distances of the locking projection 22 and the protrusion 25. An arcuate guiding surface 28 is formed at the projecting end of the rear surface of the stabilizer 27 as seen in the inserting direction ID. Thus, the stabilizer 27 is not likely to get caught during the withdrawal of the male terminal fitting 10 from the cavity 33. The supporting piece 19 is divided into front and rear portions by an escaping portion 29 at its intermediate position for receiving the stabilizer 27.

The distance A between the stabilizer 27 and the locking projection 22 is smaller than an outer diameter B of the wire W to be connected, as shown in FIG. 7. Thus, the wire W will not enter a clearance between the stabilizer 27 and the locking projection 22 to get caught by the rear edge of the locking projection 22. Thus, the front portion 18*a* of the outer wall 18 undergoes such a deformation as to be turned. The distance A between the stabilizer 27 and the locking projection 22 is shorter than a length C of a rear portion 34*a* of the bottom wall 34 of each cavity 33 at the lower stage and is shorter than a length D of each locking section 41. Thus, the rear portion 34*a* of the bottom wall 34 and the locking section 41 cannot enter the clearance between the stabilizer 27 and the locking projection 22. A distance E between the stabilizer 27 and the protrusion 25 is shorter than the length C of the rear portion 34*a* of the bottom wall 34 and the length D of the locking section 41.

Figure 8:
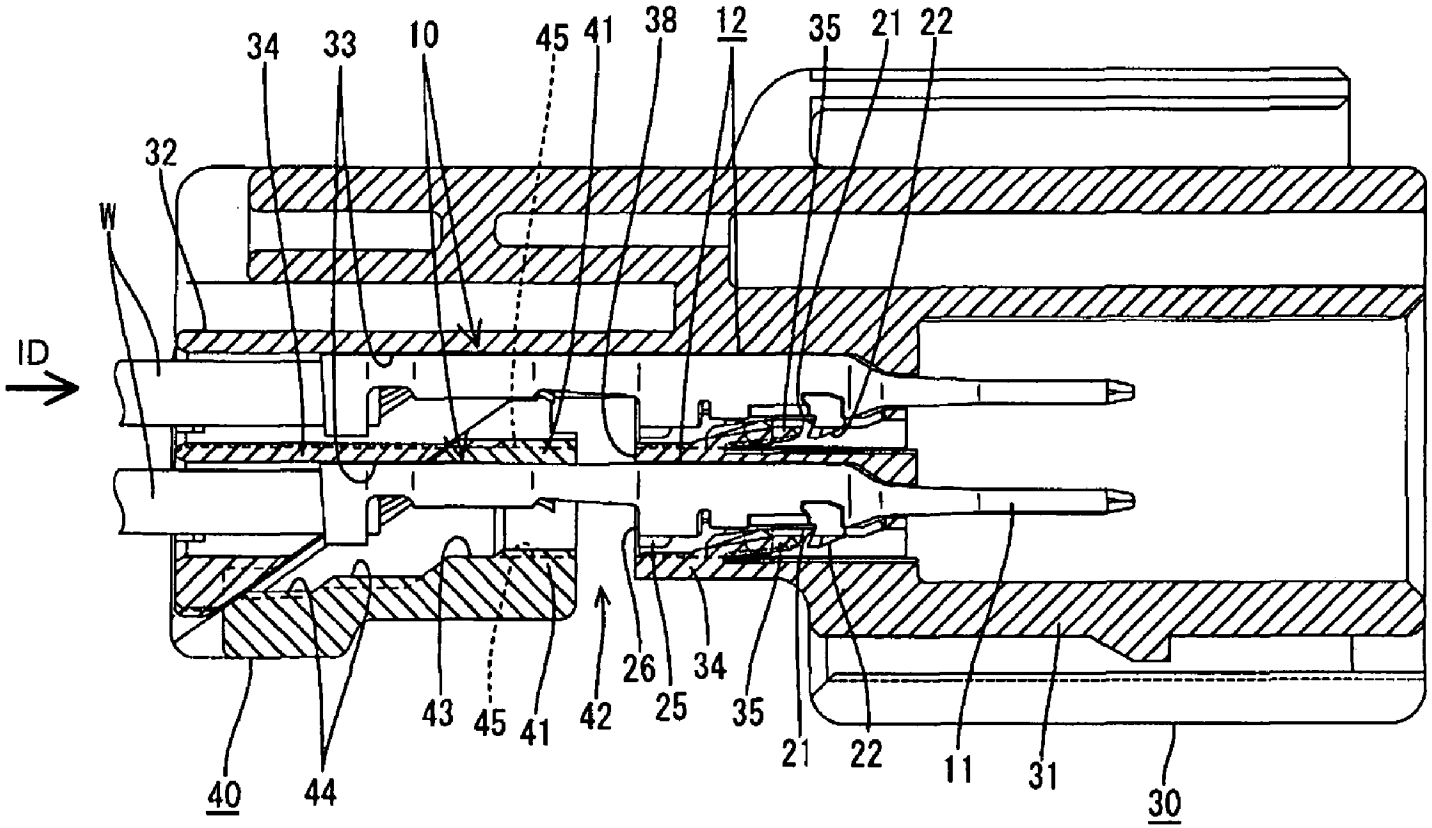
FIG. 8 is a side view in section showing a state where the male terminal fittings are inserted to a proper depth in cavities.

The wire W is connected with the barrel 13 of the male terminal fitting 10 by crimping. The male terminal fitting 10 then is inserted into the housing 30 while the retainer 40 is at the partial locking position shown in FIG. 7. More particularly, the male terminal fitting 10 is inserted into the cavity 33 from behind and along the inserting direction ID. Thus, the locking projection 22 and the protrusion 25 enter the protrusion insertion groove 36 from behind. Additionally, the stabilizer 27 enters the stabilizer insertion groove 37 and the stabilizer passing groove 45, so that the inserting operation is guided smoothly. The locking projection 22 resiliently deforms the lock 35 out and down when the male terminal fitting 10 reaches a specified depth. The locking projection 22 moves over the lock 35 when the male terminal fitting 10 reaches a proper depth. Thus, the lock arm is restored resiliently, as shown in FIG. 8 and the lock 35 enters the notch 21 of the male terminal fitting 10. The upper part of the lock 35 engages the rear end surface of the front portion 18*a* of the outer wall 18 and the lower part thereof engages the rear end surface of the locking projection 22 for partly locking the male terminal fitting 10.

Figure 9:
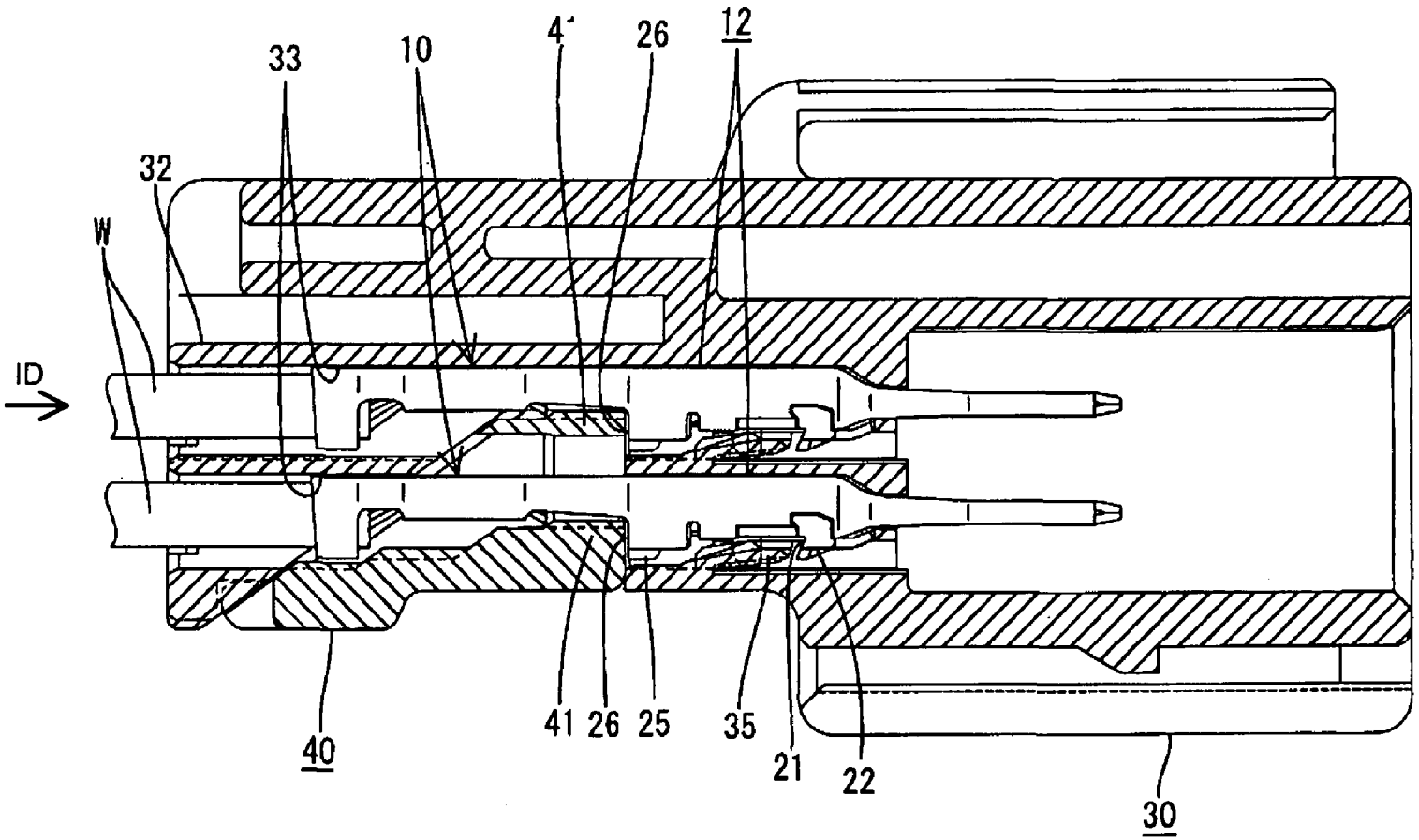
FIG. 9 is a side view in section showing a state reached after the retainer is pushed to a full locking position.
Figure 10:
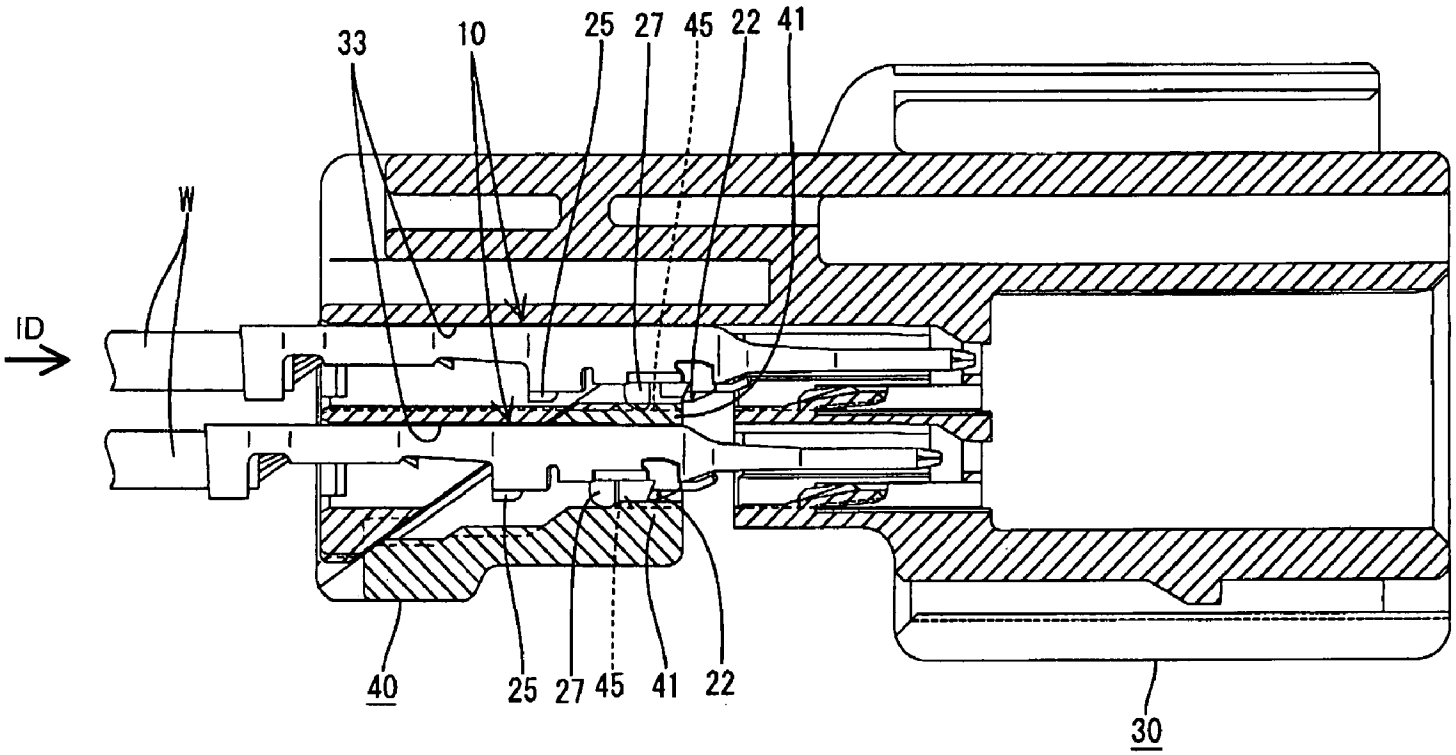
FIG. 10 is a side view in section showing a state where the male terminal fitting is insufficiently inserted.

The retainer 40 is pushed in the pushing direction PD from the partial locking position (FIG. 7) to the full locking position (FIG. 9) after all the male terminal fittings 10 are inserted. The respective locking sections 41 enter the cavities 33 to engage the locking steps 26 and the protrusions 25 when the retainer 40 reaches the full locking position, as shown in FIG. 9. Thus, the male terminal fittings 10 are locked fully. At this time, the front edge of the retainer mount hole 38 and the front surface of the retainer 40 are held together with substantially no clearance therebetween. Thus, entry of external matter is prevented The male terminal fittings 10 may be inserted insufficiently. However, the distance A along the inserting direction ID between the stabilizer 27 and the locking projection 22 is shorter than the length C of the locking section 41 along the inserting direction ID. Thus, the locking section 41 does not enter the clearance between the stabilizer 27 and the locking projection 22. Rather, the upper surface of the locking section 41 contacts the lower surfaces of the locking projection 22 and the stabilizer 27, as shown in FIG. 10, to prevent the retainer 40 from being pushed. The male terminal fitting 10 may be inserted deeper than in FIG. 10. However, the distance E between the stabilizer 27 and the protrusion 25 is shorter than the length C of the locking section 41. Thus, the locking section 41 does not enter the clearance between the stabilizer 27 and the locking projection 22, but instead contacts the upper surface of the locking section 41 to prevent the retainer 40 from being pushed. In this way, one of the locking projection 22, the stabilizer 27 and the protrusion 25 interferes with the locking section 41 to prevent the retainer 40 from being pushed unless the main portion 12 has passed the locking section 41. As a result, the insufficient insertion of the male terminal fitting 10 can be detected.

Figure 11:
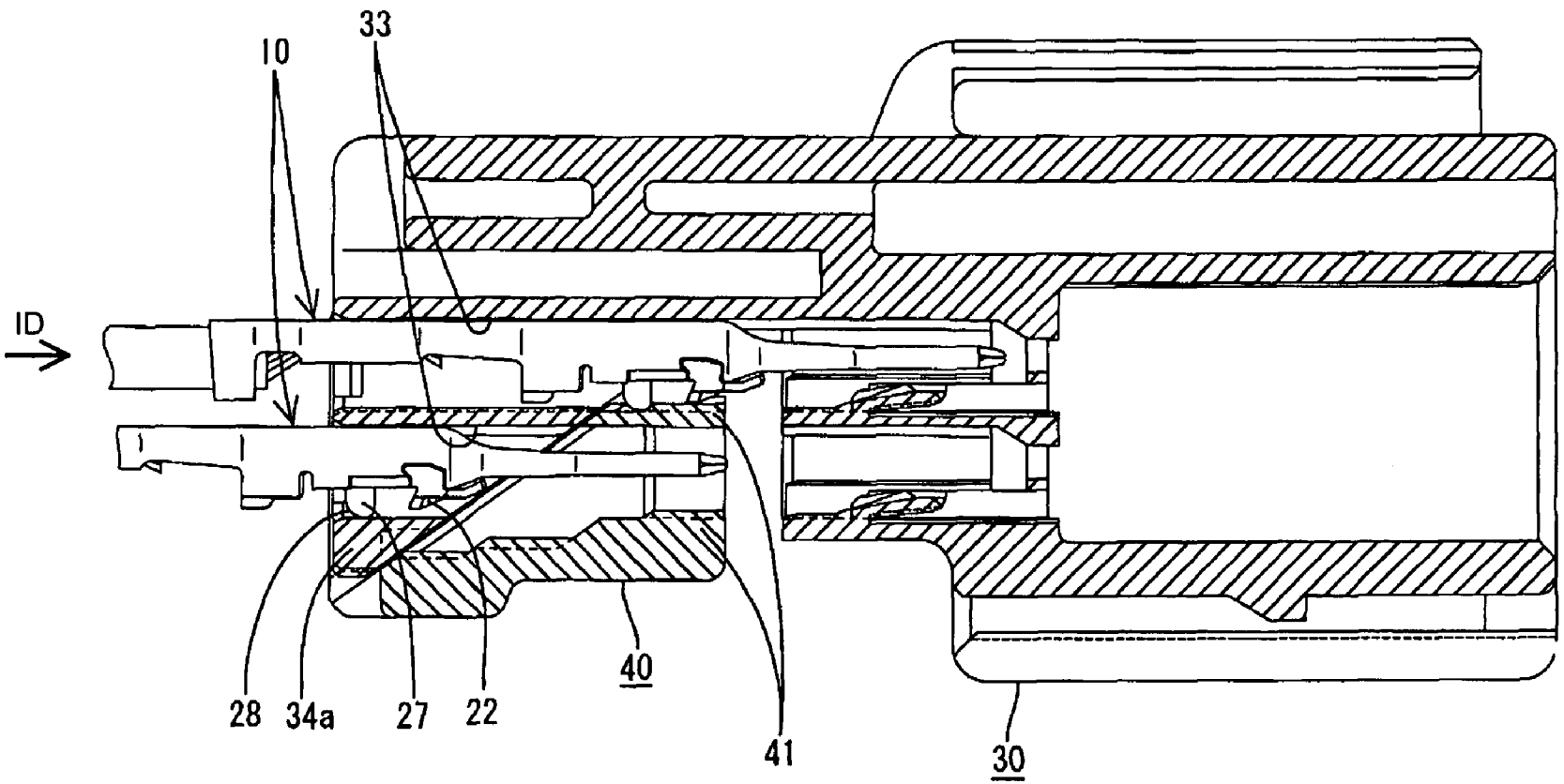
FIG. 11 is a side view in section showing a process of withdrawing the male terminal fitting.

The male terminal fitting 10 may have to be withdrawn for maintenance or other reason. In such a case, the retainer 40 is returned to the partial locking position to disengage the locking sections 41 from the male terminal fittings 10. The lock 35 then is deformed by an unillustrated jig to be disengaged from the corresponding male terminal fitting 10 and the wire W is pulled. The distance A between the locking projection 22 and the stabilizer 27 is shorter than the length D of the rear portion 34*a* of the bottom wall 34. Thus, the locking projection 22 reaches the rear portion 34*a* of the bottom wall 34 while the stabilizer 27 is held substantially in contact with the rear portion 34*a* as shown in FIG. 11. Therefore, the male terminal fitting 10 cannot move down to fit the locking section 41 into the clearance between the stabilizer 27 and the locking projection 22, and withdrawing operability is better. Further, the arcuate guiding surface 28 on the rear surface of the stabilizer 27 makes the stabilizer 27 is less likely to get caught in the withdrawing process.

As described above, the stabilizer 27 is near the rear side of the locking projection 22 in the main portion 12 and projects in substantially the same direction as the locking projection 22. Accordingly, the wire W and the operator's finger are not easily caught by the rear edge of the locking projection 22 before insertion of the male terminal fitting 10. Thus, the male terminal fitting 10 can be handled more easily handled. Therefore, the front portion 18*a* of the outer wall 18 where the locking projection 22 is not likely to be deformed and turned.

Further, the stabilizer 27 is provided at the side edge of the notch 21 and can be formed taking advantage of the portion of the outer wall 18 cut out by the notch 21. Thus, the male terminal fittings 10 can be produced at lower costs with a better yield.

The stabilizer 27 prevents the rear edge of the locking projection 22 from being caught and also guides the insertion of the male terminal fitting 10. Thus, the construction of the male terminal fitting 10 can be simpler as compared to a case where two separate parts fulfill these functions.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The stabilizer is provided at substantially the longitudinal middle of the notch in the foregoing embodiment. However, this position can be shifted forward or back. In such a case, the position of the escaping portion formed in the supporting piece may be shifted in conformity with the position of the stabilizer. Further, the stabilizer can be located at a position before (behind) the supporting piece to omit the escaping portion.

The front and rear portions of the outer wall are coupled to the different side walls in the foregoing embodiment. However, the present invention is also applicable to terminal fittings in which front and rear portions of an outer wall are coupled to the same side wall.

The outer wall that has only one side edge coupled to the side walls is provided with the notch in the foregoing embodiment. However, the notch may be formed in the bottom wall having the opposite side edges coupled to the side walls and the locking projection may be at the front cut end thereof. In such a case, the stabilizer (catch restricting portion) may be provided at either one of the side edges of the notch or at both side edges. Alternatively, the side wall of the main portion may have the notch and the locking projection.

The stabilizer prevents the locking projection from being caught and also guides the insertion of the male terminal fitting in the foregoing embodiment. However, a catch restricting portion may be provided separately from the stabilizer.

The lock enters the notch in the foregoing embodiment. However, the locking section of the retainer may enter the notch.

Although the male terminal fitting is shown in the foregoing embodiment, the present invention is also applicable to female terminal fittings.

What is claimed is:

1. A terminal fitting to be locked by a lock inside a housing, wherein:

a notch formed in an outer wall of a main portion for permitting the entrance of the lock, a locking projection projecting out at a front cut edge of the notch, the lock being engageable with the cut front edge and with the locking projection, and a catch restricting portion provided at a side edge of the notch and projecting in a substantially a common direction with the locking projection for restricting catching of the locking projection, a distance between the catch restricting portion and the locking projection is smaller than an outer diameter of a wire to be connected to the terminal fitting.

2. The terminal fitting of claim 1, wherein the catch restricting portion includes a stabilizer for guiding an inserting operation by entering an insertion groove in the housing.

3. The terminal fitting of claim 1, wherein a portion of the terminal fitting is embossed to form a protrusion that reaches substantially the same height as the locking projection.

4. A terminal fitting to be locked by a lock inside a housing, wherein:

a notch formed in an outer wall of a main portion for permitting the entrance of the lock, a locking projection projecting out at a front cut edge of the notch, the lock being engageable with the cut front edge and with the locking projection, and a catch restricting portion provided at a side edge of the notch and projecting in a substantially a common direction with the locking projection for restricting catching of the locking projection, an arcuate guiding surface being formed on a rear surface of the catch restricting portion as seen in an inserting direction of the terminal fitting into the housing.

5. The terminal fitting of claim 4, wherein a distance between the catch restricting portion and the locking projection is smaller than an outer diameter of a wire to be connected to the terminal fitting.

6. A connector comprising:

a housing having at least one cavity, a lock projecting into the cavity;

a terminal fitting insertable into the cavity, a notch formed in an outer wall of a main portion of the terminal fitting for receiving the lock, a locking projection projecting out at a front cut edge of the notch, the lock being engageable with the cut front edge and with the locking projection, and a catch restricting portion provided at a side edge of the notch and projecting in a substantially a common direction with the locking projection for restricting catching of the locking projection; and a retainer mountable to the housing for engaging and locking the terminal fittings, wherein a distance between the catch restricting portion and the locking projection is shorter than a length of each locking section of the retainer.

7. The connector of claim 6, wherein a distance between the catch restricting portion and the locking projection is shorter than a length of a rear portion of a lateral wall of each cavity.

8. The connector of claim 6, wherein a portion of the terminal fitting is embossed to form a protrusion that reaches substantially the same height as the locking projection, and wherein a distance between the catch restricting portion and the protrusion is shorter than the length of the locking section of the retainer.

9. The connector of claim 6, further comprising a groove formed in the cavity, the catch restricting portion being slid into the groove.

10. A terminal fitting having opposite front and rear ends, the front end being configured for connection with a mating terminal fitting, the rear end defining a barrel configured for connection with a wire, a main portion between the front and rear ends, a notch formed in an outer wall of the main portion and having a cut front edge and side edges extending rearward from the front cut edge, a locking projection projecting out a selected projecting distance in a projecting direction at the front cut edge, a catch restricting portion provided at one of said side edges of the notch and projecting out further than the projecting distance substantially in the projecting direction for restricting catching of the locking projection, wherein the catch restricting portion has a rounded rear edge.

11. The terminal fitting of claim 10, wherein a part of the main portion rearward of the notch is embossed to form a protrusion extending in the projecting direction a distance substantially equal to the projecting distance of the locking projection.

12. A terminal fitting having opposite front and rear ends, the front end being configured for connection with a mating terminal fitting, the rear end defining a barrel configured for connection with a wire, a main portion between the front and rear ends, a notch formed in an outer wall of the main portion and having a cut front edge and side edges extending rearward from the front cut edge, a locking projection projecting out a selected projecting distance in a projecting direction at the front cut edge, a catch restricting portion provided at one of said side edges of the notch and projecting out further than the projecting distance substantially in the projecting direction for restricting catching of the locking projection, wherein the barrel is configured for connection with a wire that has a diameter, and the catch restricting portion is spaced from the locking projection by a distance less than the diameter.

13. The terminal fitting of claim 12, wherein the catch restricting portion has a rounded rear edge.

* * * * *